US005987813A

United States Patent [19]

Lasko

[11] Patent Number: 5,987,813

[45] Date of Patent: Nov. 23, 1999

[54] CHRISTMAS TREE STAND

[75] Inventor: William E. Lasko, West Chester, Pa.

[73] Assignee: Lasko Holdings Inc., West Chester, Pa.

[21] Appl. No.: 09/017,613

[22] Filed: Feb. 2, 1998

[51] Int. Cl.[6] ..... A01G 7/02

[52] U.S. Cl. ..... 47/40.5

[58] Field of Search ..... 47/40.5, 42, 43, 47/47, 48.5; 248/527

[56] References Cited

U.S. PATENT DOCUMENTS

| | | | |
|---|---|---|---|
| 1,931,376 | 10/1933 | Cosner | 47/40.5 |
| 3,137,969 | 6/1964 | Sokol | 47/57.5 |
| 5,669,178 | 9/1997 | Petrovic | 47/40.5 |

FOREIGN PATENT DOCUMENTS

| | | | |
|---|---|---|---|
| 90084 | 8/1957 | Norway | 47/40.5 |

*Primary Examiner*—Michael J. Carone
*Assistant Examiner*—Frank Palo
*Attorney, Agent, or Firm*—Zachary T. Wobensmith, III

[57] ABSTRACT

A Christmas tree stand for mounting and displaying a Christmas tree, which in one embodiment includes a cylindrical base, a bucket for engagement with the trunk of a tree with slots therein, which bucket is carried in the base, a top cover on the tree trunk, a reservoir base integral with the cylindrical base, a water pan engaged with the base, a water reservoir detachably engaged with an extension of the water pan to supply water thereto, and hold down latches on the base detachably engaged with the top cover to retain the bucket in the base, and for the other embodiment the base directly captures and retains the tree trunk without using the bucket.

7 Claims, 4 Drawing Sheets

64
63

66
65
68
10
58
40
62
62
43
57
44
47
61
61
45
46
59
60
42
43
48
56
67
55
41
11.A
67
11
49
2
19
18
28
17
27
12
15
50
16
23
36
22
51
20
25
35
26
21
26

140
146
147
144
142
145
143
100
149
148
141
50
52
155
161
101
115
112
119
117
118
123
122
120
151
121
125
126
136
135
126

CHRISTMAS TREE STAND

BACKGROUND OF THE INVENTION

Field of the Invention

This invention relates to a Christmas tree stand of the type which removably retains the tree in a base, which base includes a removable reservoir tank to supply water to the tree.

DESCRIPTION OF THE PRIOR ART

There is considerable interest in keeping live cut Christmas trees as fresh as possible during the season while they are displayed indoors. These trees require water as soon as possible as they are often cut and stored for some time prior to purchase by the consumer, and it is important for fire and other reasons to provide water directly to the base of the tree, and to keep it supplied with water. Many approaches have been proposed such as shown in U.S. Pat. Nos. 5,522,179; 5,507,117; 5,493,277; 5,492,301; 5,473,838; 5,473,837; 5,388,799; 5,375,808; 5,350,149; 5,333,828; 5,320,323; 5,209,450; 5,201,140; 5,009,028; 4,901,971; 4,825,586; 4,796,017; 4,750,702; and 4,006,560, but none of them provides the solution.

The stand must be durable, inexpensive to construct and easy to service.

The tree stand of the invention securely retains the tree base, supplies water directly to the tree base, and has a removable reservoir tank.

SUMMARY OF THE INVENTION

This invention relates to a Christmas tree stand, which may include a bucket which captures and surrounds the trunk of the tree, and is detachably carried in the base of the stand, or which directly captures and retains the tree in the base, which base has an integral reservoir to receive a removable water reservoir tank, and a water pan in contact with the reservoir tank which closes off the bottom of the stand.

The principal object of the invention is to provide a Christmas tree stand which has a removable water reservoir tank.

A further object of the invention is to provide a Christmas tree stand which is constructed of molded plastic.

A further object of the invention is to provide a Christmas tree stand which captures the tree trunk in a bucket which is removably carried in the base of the stand.

A further object of the invention is to provide a Christmas tree stand which captures and retains the end of the tree trunk in the base of the stand.

A further object of the invention is to provide a Christmas tree stand that is simple and inexpensive to construct, but durable and long lasting in use.

A further object of the invention is to provide a Christmas tree stand with a water reservoir tank which provides a visual indication of the water level in the reservoir tank, and is resistant to spillage.

A further object of the invention is to provide a Christmas tree stand that is easy to assemble and use.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structures disclosed without departing from the spirit of the invention.

Like numerals refer to like parts throughout the several views.

DESCRIPTION OF THE PREFERRED EMBODIMENTS

When referring to the preferred embodiments, certain terminology will be utilized for the sake of clarity. Use of such terminology is intended to encompass not only the described embodiment, but also technical equivalents which operate and function in substantially the same way to bring about the same result.

Figure 1:
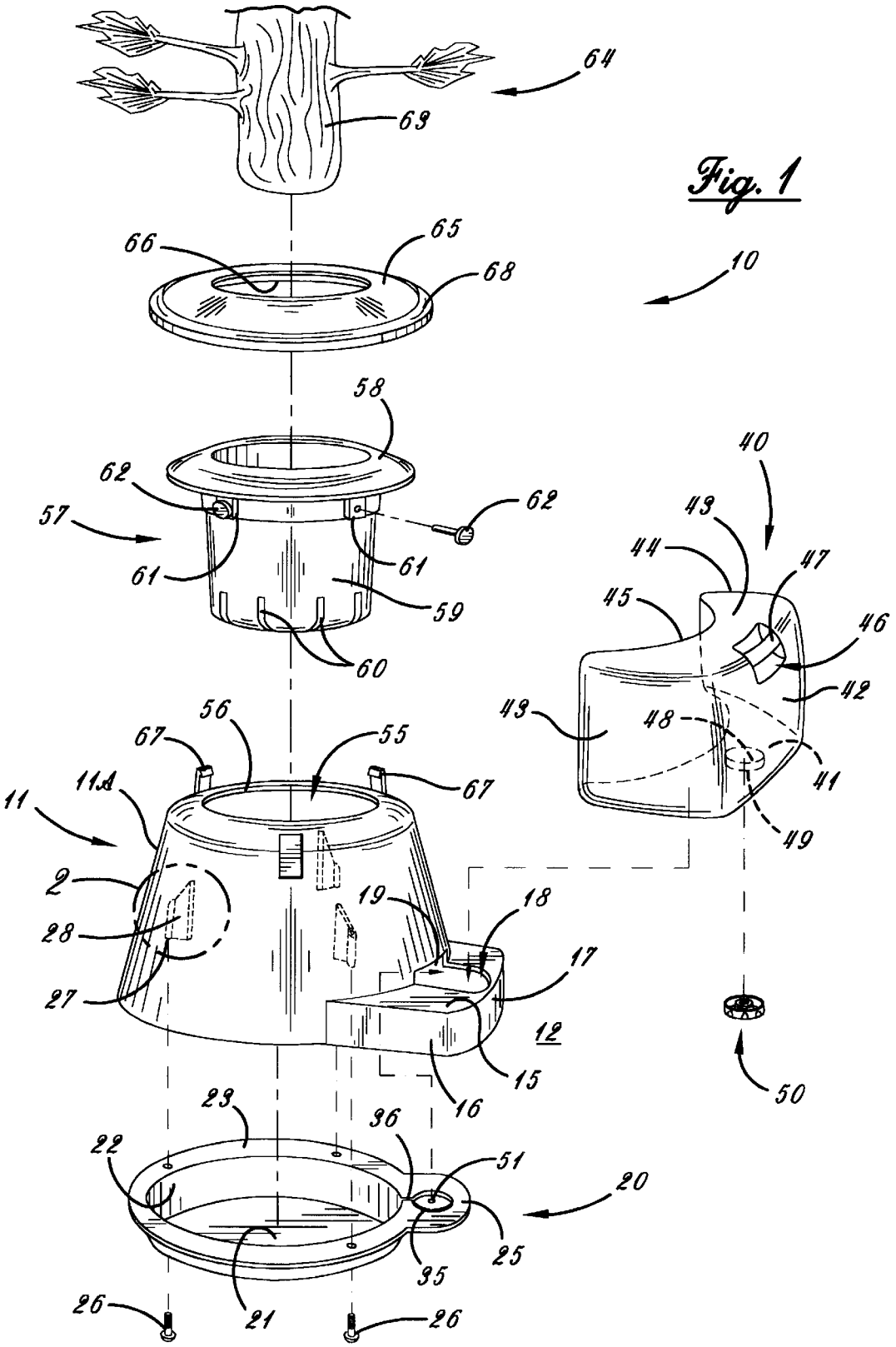
FIG. 1 is an exploded perspective view of one embodiment of the Christmas tree stand of the invention.
Figure 3:
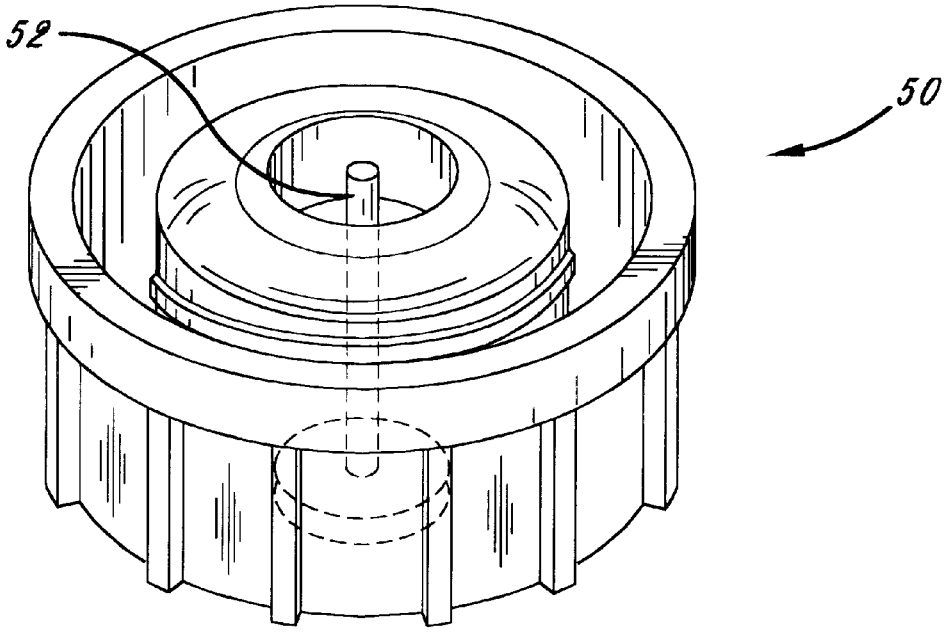
FIG. 3 is a perspective view, enlarged in partial phantom of the cap for the water reservoir tank of the invention.

Referring now more particularly to FIGS. 1 and 3 of the drawings, one embodiment of the Christmas tree stand 10 is therein illustrated.

The stand 10 includes a base 11 of cylindrical configuration having a wall 11A, which stand is hollow and includes an integral reservoir base 12, which base 12 includes a rim or top wall 15, side walls 16, and a front wall 17.

The top wall 15 has a semi-circular opening 18 therein, and a rectangular opening 19 is provided in wall 11A.

A water pan 20 is provided, of circular configuration, with a bottom wall 21, side wall 22 and flat top wall 23.

The top wall 23 is provided with an extension 25 which upon assembly to the base 11 extends into the reservoir base 12 to be described.

The water pan top wall 23 has a plurality of threaded fasteners 26 (three shown) which are engaged in bosses 27, part of ribs 28, which are integral with the wall 11A of stand 10.

Figure 2:
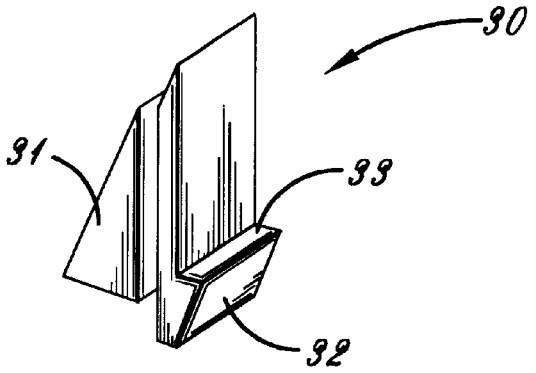
FIG. 2 is a spot view, enlarged, of an alternate form of attachment of the water pan to the base of the stand.

Referring to FIG. 2 an alternate structure for fastening the water pan 20 to the wall 11A is provided, which includes a plurality of integral tongues 30, mounted on bosses 31, which extend downwardly from the base wall 11A, which have a tapered front wall 32, and a hook 33, which snaps over the flat top wall 23 of water pan 20 to retain it in stand 10.

The water pan 20 has a circular raised rim 35 on extension 25, with a slot 36 which extends across the rim 35 towards the center of pan 20 to permit the flow of water therethrough onto bottom wall 21, and side wall 22 to be described.

A water reservoir tank 40 is provided, which is constructed of clear plastic, and includes a flat bottom wall 41, with front wall 42, side walls 43, and top wall 44. A rear wall 45 connects the top wall 44, bottom wall 41 and side walls 43, and which is contoured to fit around the cylindrical wall 11A.

A recess 46 is provided in front wall 42 of reservoir tank 40, with a transverse handle 47 for carrying the reservoir tank.

The bottom wall 41 has an opening 48 with a threaded hollow extension 49 extending downwardly therefrom, which has a reservoir cap 50 engaged therewith, of well known type, with a poppet valve 52 therein of well known type, which is actuated when the cap 50 is engaged with the raised rim 35, by an upstanding pin 51 in the center of extension 25, allowing water (not shown) to flow out of the valve 52 in cap 50 and down slot 36 into pan 20.

The stand 10 has a circular opening 55 in a top wall 56, which is intended to receive a bucket 57, which has a top rim 58, and a cup 59 extending downwardly therefrom, with a plurality of slots 60 therethrough spaced therearound. The cup 59 of bucket 57 has a plurality of bosses 61 spaced therearound, four being preferred, with threaded fasteners 62 extending therethrough to engage the trunk 63 of a tree 64 in conventional manner.

A top cover 65 is provided which has an opening 66 to receive the tree trunk 63, engages the top rim 58 of bucket 57 and retains the bucket rim 58 on the top wall 56, by engagement of a plurality of hold down latches 67 of well known type, with a rim 68 on cover 65, three being shown which are mounted on base wall 11A.

The base 11, water pan 20, bucket 57, and top cover 65 may be constructed of polypropylene or other suitable moldable plastic as desired.

Figure 4:
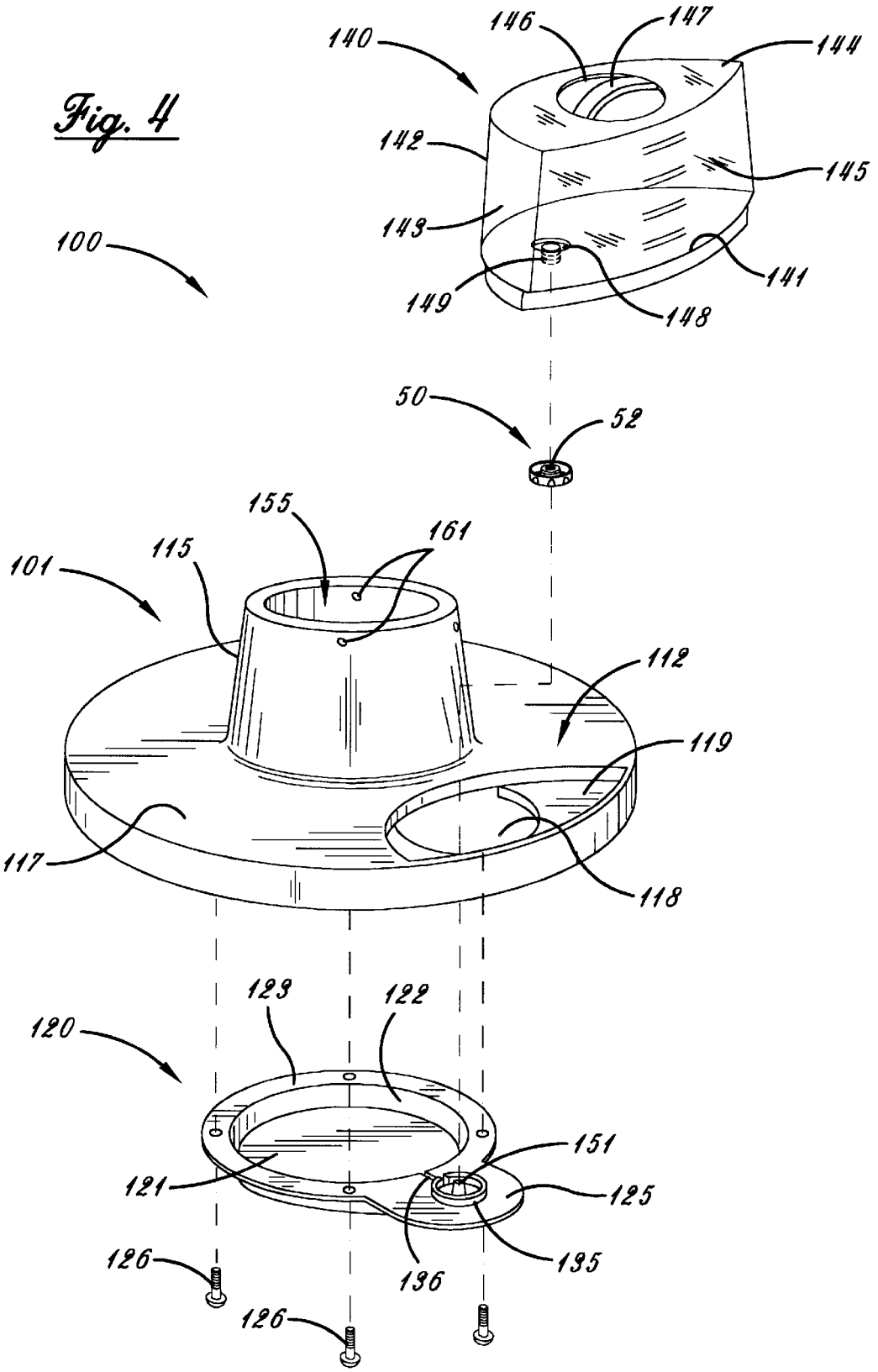
FIG. 4 is an exploded perspective view of another embodiment of the Christmas tree stand of the invention.
Figure 5:
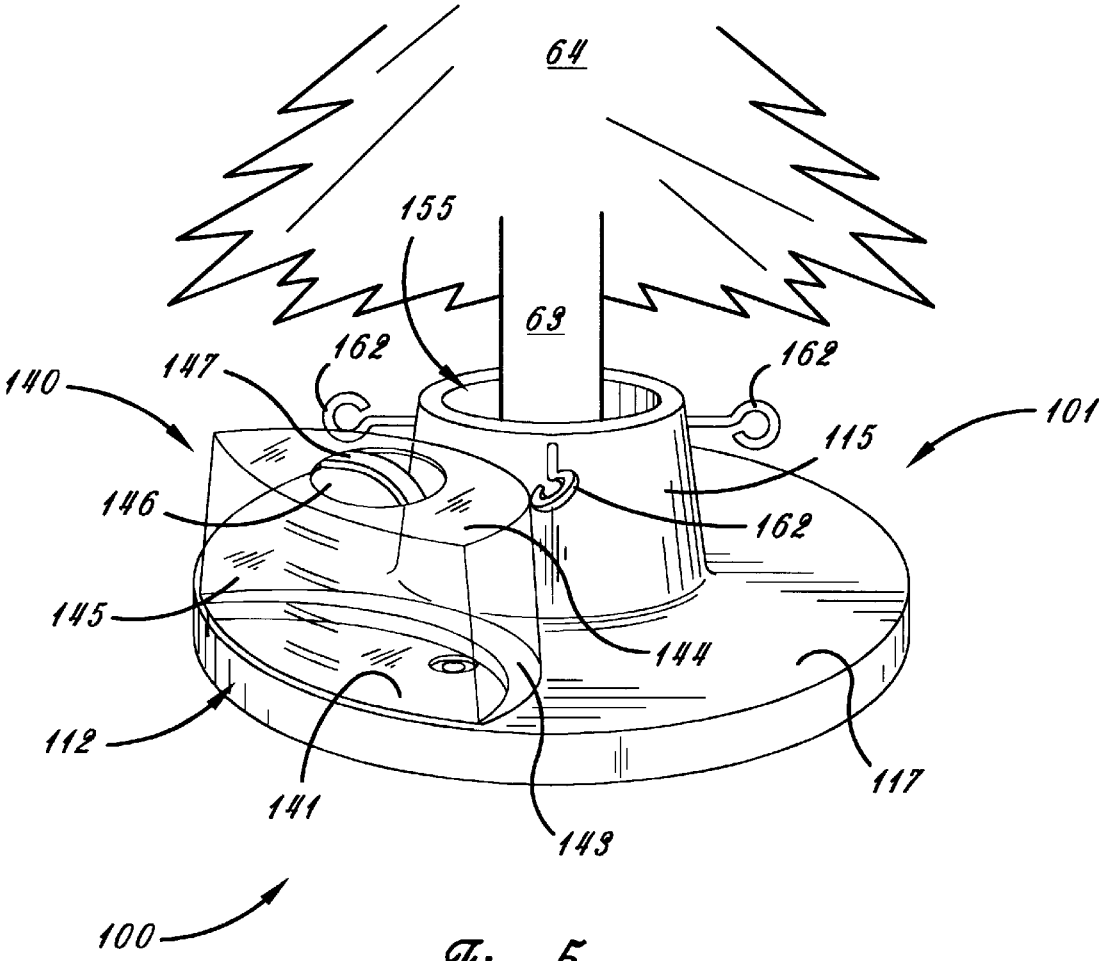
FIG. 5 is a perspective view of the stand of FIG. 4 in assembled condition.

Referring now more particularly to FIGS. 4 and 5 of the drawings, another embodiment of Christmas tree stand 100 is therein illustrated.

The stand 100 includes a base 101 of cylindrical configuration, which stand is hollow and includes an integral reservoir base 112, which base 101 includes a cylindrical portion 115, and a saucer like bottom portion 117.

The bottom portion 117 has a semi-circular opening 118 therein, and a top wall 119.

A water pan 120 is provided similar to water pan 20, of circular configuration, with a bottom wall 121, side wall 122 and flat top wall 123.

The top wall 123 is provided with an extension 125 which upon assembly to the base 101 extends into the reservoir base 112 to be described.

The water pan top wall 123 may have a plurality of threaded fasteners 126 (four shown) which are engaged in bosses (not shown), part of ribs (not shown) which are integral with the wall bottom portion 117 of stand 110.

The water pan 120 may also be secured by an alternate structure as described for FIG. 2 above.

The water pan 120 has a circular raised rim 135 on extension 125, with a slot 136 which extends across the rim 135 towards the center of pan 120 to permit the flow of water therethrough to be described.

A water reservoir tank 140 is provided, which is constructed of a clear plastic, and includes a flat bottom wall 141, with front wall 142, side walls 143, and top wall 144. A rear wall 145 connects the top wall 144, bottom wall 141 and side walls 143.

A recess 146 is provided in top wall 144 of reservoir 140, with a transverse handle 147 for carrying the reservoir.

The bottom wall 141 has an opening 148 with a threaded hollow extension 149 extending downwardly therefrom, which has a reservoir cap 50 engaged therewith, as previously described, with a poppet valve 52 therein, which is actuated when the cap 50 is engaged with the raised rim 135, and by an upstanding pin 151 in the center of extension 125, allowing water (not shown) to flow out of the valve 52 in the cap 50 and down slot 136 into pan 120.

The stand 100 has a circular opening 155 in the cylindrical portion 115, which is intended to receive a trunk 63 of a tree 64. The cylindrical portion 115 has a plurality of threaded openings 161 spaced therearound, four being preferred, with threaded fasteners 162 extending therethrough to engage the trunk 63 of the tree 64 in conventional manner.

The base 101 and water pan 120, may be constructed of polypropylene or other suitable moldable plastic as desired.

The mode of operation and use will now be pointed out.

The water pan 20 or 120 are assembled to base 11 or 101 by fasteners 26, 126, or by tongues 30. For base 11, the tree trunk 63 is prepared and the top cover 65 is placed on the trunk 63, which is inserted into bucket 57, and the fasteners 62 turned in to engage the trunk 63, and adjusted for the straightness of the trunk 63.

The bucket 57 is inserted into opening 66 and the rim 68 of top cover 65 is engaged by the hold down latches 67.

The cap 50 is removed from the water reservoir tank 40 which is filled with water and the cap replaced. The reservoir tank 40 is placed on top wall 15 of reservoir base 12, with the pin 51 engaging the valve 52 in cap 50 permitting water to flow thereout, down slot 36 and into the pan 20, as required. The water level in the reservoir tank 40 can be easily observed, and the tank removed to add water, as required.

For base 101 the tree trunk 63 is prepared and inserted into opening 155 and the fasteners 162 turned in to contact the tree trunk 63 and adjusted as required. The water reservoir 140 is filled with water and placed on top wall 119 with valve 52 engaged with pin 151 allowing water to flow thereout and into pan 120.

It will thus be seen that structure has been provided with which the objects of the invention are attained.

I claim:

1. A Christmas tree stand for mounting the trunk of a tree which comprises a cylindrical base having a wall, a reservoir base integral with said cylindrical base wall and, having an opening therethrough, a circular water pan to receive water to feed said tree having a bottom wall, a side wall and a flat top wall, means for securing said pan in said cylindrical base whereby said pan top wall is in contact with said cylindrical base, said pan having an extension which extends in said opening in said reservoir base, said extension having a circular raised rim with a slot therethrough and an upstanding pin, a water reservoir tank of clear plastic having a bottom wall with an opening and a threaded hollow extension extending therefrom, a threaded cap in detachable engagement with said hollow extension of said tank, a valve in said cap for engagement with said pin to permit water to flow thereout, said cylindrical base wall having a top wall thereon with a circular opening therethrough, and means in said cylindrical base to engage the trunk of said tree, and to removably retain it in said base.

2. A Christmas tree stand as defined in claim 1 in which said means for securing said water pan to said cylindrical base includes a plurality of fasteners extending through said water pan top wall, and a plurality of bosses carried on ribs which are integral with said cylindrical base wall to receive said fasteners.

3. A Christmas tree stand as defined in claim 1 in which said cylindrical base wall includes a plurality of tongues extending downwardly therefrom, hooks on said tongues to engage said top wall of said water pan, and to retain said pan in said cylindrical base.

4. A Christmas tree stand as defined in claim 1 in which said means to retain said tree trunk in said base includes a bucket to engage the trunk of said tree, said bucket having a top wall and a cup extending from said top wall, a plurality of slots in said cup to permit water to flow into said cup, means carried by said cup to engage said tree trunk, a top cover adapted to encircle said trunk and engaging said bucket top wall, said top cover having a rim therearound, means carried by said base wall to engage said top cover rim and to detachably retain said bucket in said base.

5. A Christmas tree stand as defined in claim 1 in which said means in said cylindrical base to engage and retain said trunk includes a cylindrical portion of said cylindrical base to engage and retain said trunk, and a plurality of threaded fasteners spaced therearound said cylindrical portion, extending therethrough to engage said tree trunk.

6. A Christmas tree stand as described in claim 4 in which said means to engage said trunk includes a plurality of threaded fasteners spaced around and engaged with said cup.

7. A Christmas tree stand as defined in claim 4 in which said means for securing said cylindrical base wall to engage said top cover rim are hold down latches.

* * * * *